US006572450B2

(12) United States Patent
Sommer et al.

(10) Patent No.: US 6,572,450 B2
(45) Date of Patent: Jun. 3, 2003

(54) ROLL FORMAT POLISHING PROCESS FOR OPTICAL DEVICES

(75) Inventors: Phillip R. Sommer, Newark, CA (US); Alexander Brudny, Saratoga, CA (US)

(73) Assignee: Iphotonics, Inc., Glen Burnie, MD (US)

( * ) Notice: Subject to any disclaimer, the term of this patent is extended or adjusted under 35 U.S.C. 154(b) by 0 days.

(21) Appl. No.: 09/957,719

(22) Filed: Sep. 21, 2001

(65) Prior Publication Data

US 2003/0060141 A1 Mar. 27, 2003

(51) Int. Cl.[7] ..... B24B 1/00

(52) U.S. Cl. ..... 451/42; 45/41; 45/59; 45/60; 45/489

(58) Field of Search ..... 451/41, 42, 59, 451/60, 297, 303, 489, 491, 285, 286, 287, 288, 290

(56) References Cited

U.S. PATENT DOCUMENTS 5,816,896 A * 10/1998 Schouwenaars ..... 451/10
5,980,367 A * 11/1999 Metcalf ..... 451/285
6,368,193 B1 * 4/2002 Carlson et al. ..... 451/168
6,386,189 B2 * 5/2002 Shimada et al. ..... 123/634

* cited by examiner

*Primary Examiner*—Joseph J. Hail, III
*Assistant Examiner*—Alvin J. Grant
(74) *Attorney, Agent, or Firm*—Moser, Patterson & Sheridan, L.L.P.

(57) ABSTRACT

Embodiments of the invention provide methods and apparatuses to process optical subsystems. In one aspect, the optical subsystems are polished using an orbital polishing apparatus adapted to polish and clean an optical subsystem interconnect surface. The orbital polishing apparatus is adapted to incrementally advance a movable web of polishing material to provide polishing uniformity and consistent polishing performance device to device.

44 Claims, 9 Drawing Sheets

ROLL FORMAT POLISHING PROCESS FOR OPTICAL DEVICES

BACKGROUND OF THE INVENTION

1. Field of the Invention

Embodiments of the invention relate to methods and apparatuses for processing optical subsystems.

2. Background of the Related Art

In the fabrication of fiber optic communication systems, optical interconnects, fiber optics, and other components are assembled to form various interconnected optical subsystems. Typically, optical components are integrated into an optical subsystem that is collectively used to create, for example an optical switch. As the communication industry's need for optical communication bandwidth has increased, the ability for interconnect surfaces to provide a precise connection between optical subsystems is becoming critical, especially with regard to optical transmission modes that use multiple wavelengths of light to transmit information such as Dense Wavelength Division Multiplexing (DWDM). DWDM is a fiber-optic transmission technique that employs multiple light wavelengths to transmit data parallel-by-bit or serial-by-character. DWDM is a major component of optical networks that allows the transmission of e-mail, video, multimedia, data, and voice—carried in Internet protocol (IP), asynchronous transfer mode (ATM), and synchronous optical network/synchronous digital hierarchy (SONET/SDH), respectively, over fiber optic communication systems.

Generally, fiber optic interconnections include two optical connections mated together to provide a continuous optical path. Conventionally, to form an optical interconnect interface, a fiber optic cable is generally terminated into an optical interconnection called a ferrule that is adapted to connect to optical systems or mating optical interconnects. Ideally, optical interconnects such as ferrules are manufactured with precisely polished and dimensionally optimized interconnect surfaces to provide low insertion loss and to prevent cross talk. Typically, ferrules are polished in batch mode where several ferrules are polished simultaneously with one polishing surface, and often are polished by hand. Unfortunately, as polishing pressure, type of polishing material, and direction of polishing between the surface of the optical components being polished and the polishing surface vary, the conventional batch process often leads to manufacturing issues such as specification repeatability, and undesirable interface aberrations affecting insertion loss, light polarization, extinction ratio, return loss performance, etc. Moreover, as polishing is done in a generally rotating fashion, particles embedded within the polishing material provided can form other aberrations such as scratches, nicks, undercuts, abrasions, etc., that can adversely affect the optical clarity of the interconnect surface and, thus, the optical transmission efficiency.

Typically, interconnection inefficiencies are overcome by additional equipment such as repeaters. Repeaters amplify the optical signal to overcome insertion loss and signal attenuation, thereby extending the optical signal broadcast range. Additionally, testing equipment such as an interferometer is used to precisely test for example, the radius of curvature and apex offset. The radius of curvature is the radius of the interconnect surface and is critical for the proper mating of interconnect surfaces. The apex offset is the measure of the interconnect optical path alignment and is critical for the proper alignment of the optical paths between two optical interconnect surfaces. Unfortunately, testing each interconnection for parameters such as radius of curvature and apex offset increases the manufacturing time and, thus, the cost of the optical subassemblies. Further, for large fiber optic communication systems employing thousands of interconnections, using equipment such as repeaters designed to overcome the interconnect inefficiencies may lead to an overall increase in the cost of the fiber optic communication system. Thus, having optical interface aberrations that affect the transmission of light can adversely affect information flow, reduce the bandwidth, reduce the efficiency of fiber optic communication systems, increase equipment costs, and generally increase the cost of the communication system.

Therefore, there is a need for a method and apparatus to provide a system for polishing optical component interfaces in a simple, repeatable, efficient, and cost effective manner.

SUMMARY OF THE INVENTION

Aspects of the invention generally provide a method and apparatus for polishing optical component interfaces used in interconnecting optical subassemblies. In one embodiment, the invention provides an apparatus for processing optical components, including a polishing apparatus having a polishing table and a polishing material supply apparatus adapted to supply polishing material proximate the polishing table, an orbital actuator rotatably coupled to the polishing apparatus and adapted to rotate the polishing apparatus in an orbital motion, and a component support adapted to position an optical component in contact with polishing material adjacent the polishing table.

In another embodiment the invention provides an apparatus for processing optical components, including an orbital actuator rotatably and flexibly coupled to a polishing apparatus having a polishing table, and a polishing material supply apparatus and a polishing material receiver coupled to the polishing apparatus wherein the polishing material supply apparatus is adapted to provide a web of polishing material to the polishing material receiver to define a renewable polishing surface adjacent the polishing table.

In another embodiment the invention provides a method of processing optical components, including rotating a polishing apparatus comprising a polishing table thereon and a polishing material supply apparatus in an orbital direction, providing from the polishing material apparatus a renewable web of polishing material positioned adjacent the polishing table, maintaining a polishing pressure of a surface of an optical component against the web of polishing material and against the polishing table, and polishing the surface.

BRIEF DESCRIPTION OF THE DRAWINGS

A more particular description of aspects of the invention, briefly summarized above, may be had by reference to the embodiments thereof, which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
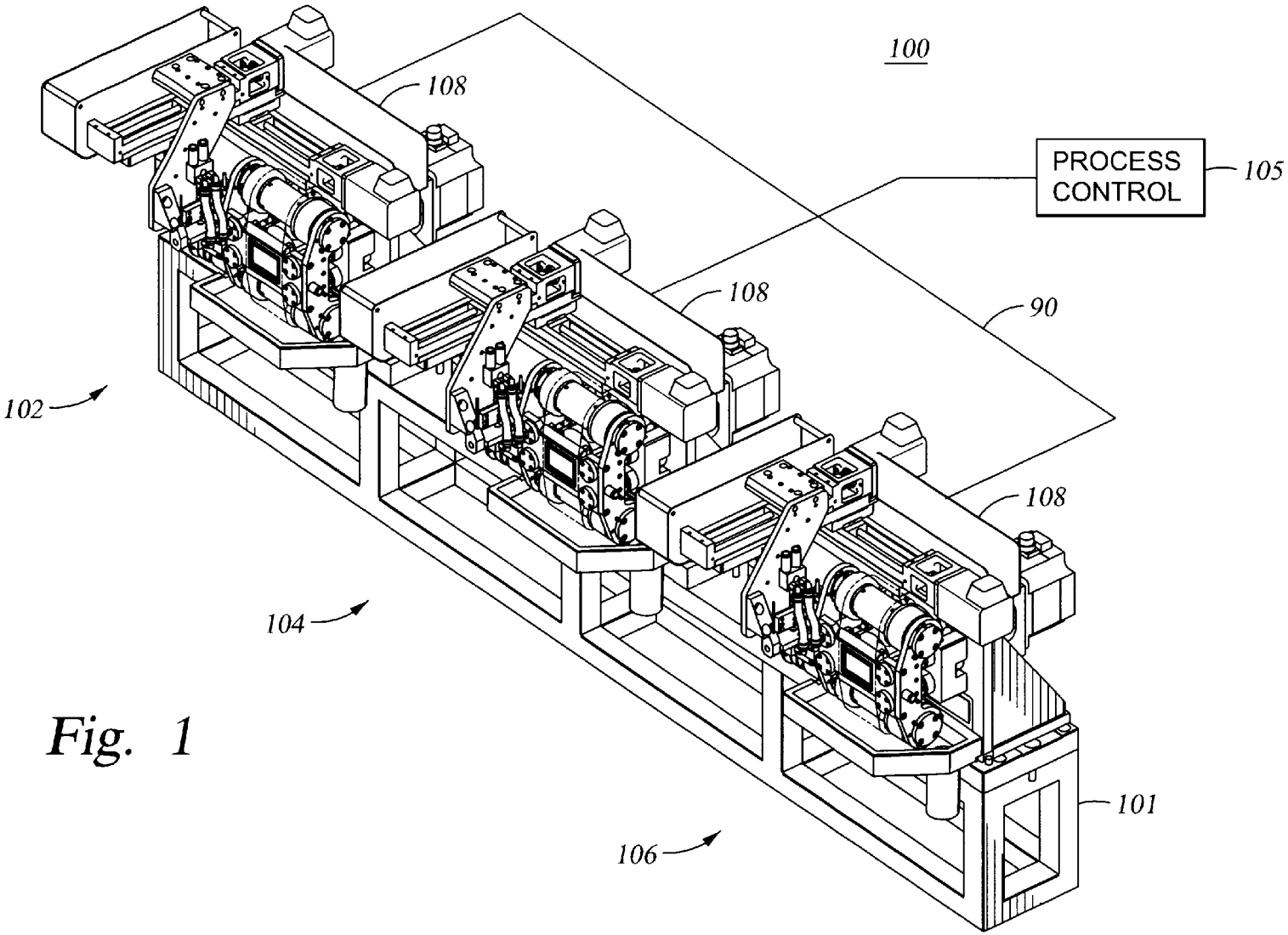
FIG. 1 is a perspective view of an optical-subsystem polishing tool.

FIG. 1 is a perspective view of one embodiment of a staged optical component polishing system 100. The staged optical component polishing system 100 is a self-contained system having the necessary processing utilities supported on a mainframe structure 101 which can be easily installed and which provides a quick start up for operation. The optical component processing system 100 shown generally includes three polishing apparatuses 108 that provide three optical component polishing stages, namely, a coarse polishing stage 102 where optical components are given an initial coarse polish, a fine polishing stage 104 where optical components are given a finer polish than the initial coarse polish, and a finish polishing stage 106 where optical components are given a final finish polish. The optical components are polished at each stage using a web of polishing material having a polishing surface thereon including materials such as silicon-carbide, diamonds, silicon-dioxide, and the like. In one aspect, after the coarse and fine polishing stages, the component is cleaned with de-ionized water. Subsequently, an inert pressurized gas such as $CO_2$ is used as a cleaning agent to remove the fine residue adhering to the optical surfaces produced during the polishing process. The substrate processing system 100 also includes a back end (not shown) which houses the support utilities needed for operation of the system 100, such as compressed air used to power portions of the system 100, de-ionized water used for cleaning, vacuum, and electrical power distribution. While the processing system illustrates three polishing stages, the arrangement and combination of the individual polishing stages may be altered for purposes of performing specific polishing steps. For example, the coarse polishing stage may be configured to provide a finish polish step.

In one aspect, the polishing processes are controlled by a process controller 105 such as programmable logic controller (PLC) or other suitable device coupled to the three optical polishing apparatuses 108 via input/output (I/O) cable 90. In general, the processing system controller 105 includes, or is coupled to, a central processing unit (CPU), and a memory. The memory contains a polishing control program that, when executed on the CPU, instructs the polishing apparatuses 108 to perform a polishing process. The polishing control program conforms to any one of a number of different programming languages. For example, the program code can be written in programmable logic controller (PLC) code (e.g., ladder logic), C, C++, BASIC, Pascal, or a number of other languages.

Figure 2:
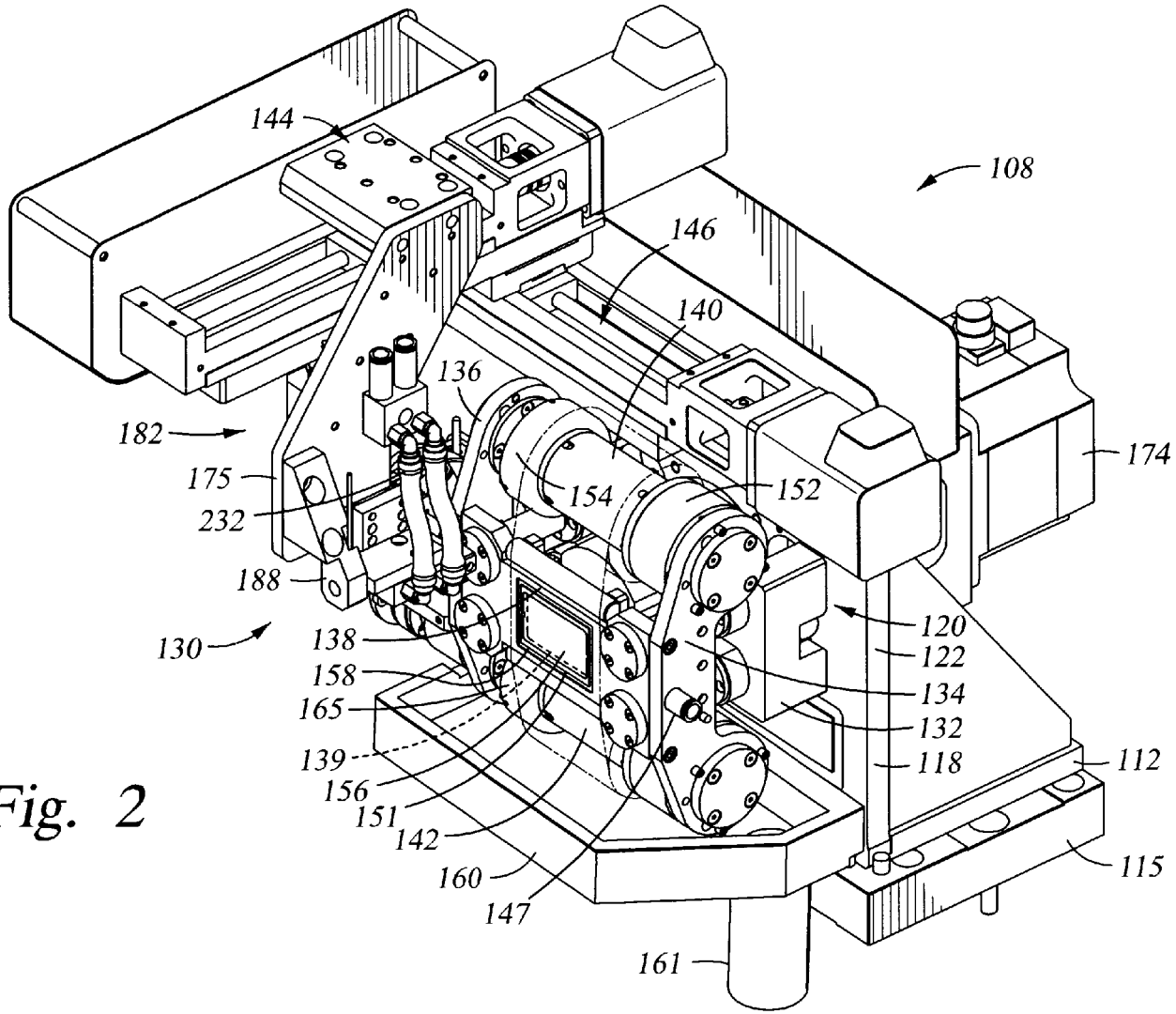
FIG. 2 is a substantially front perspective view of the optical-subsystem polishing tool of FIG. 1.
Figure 3:
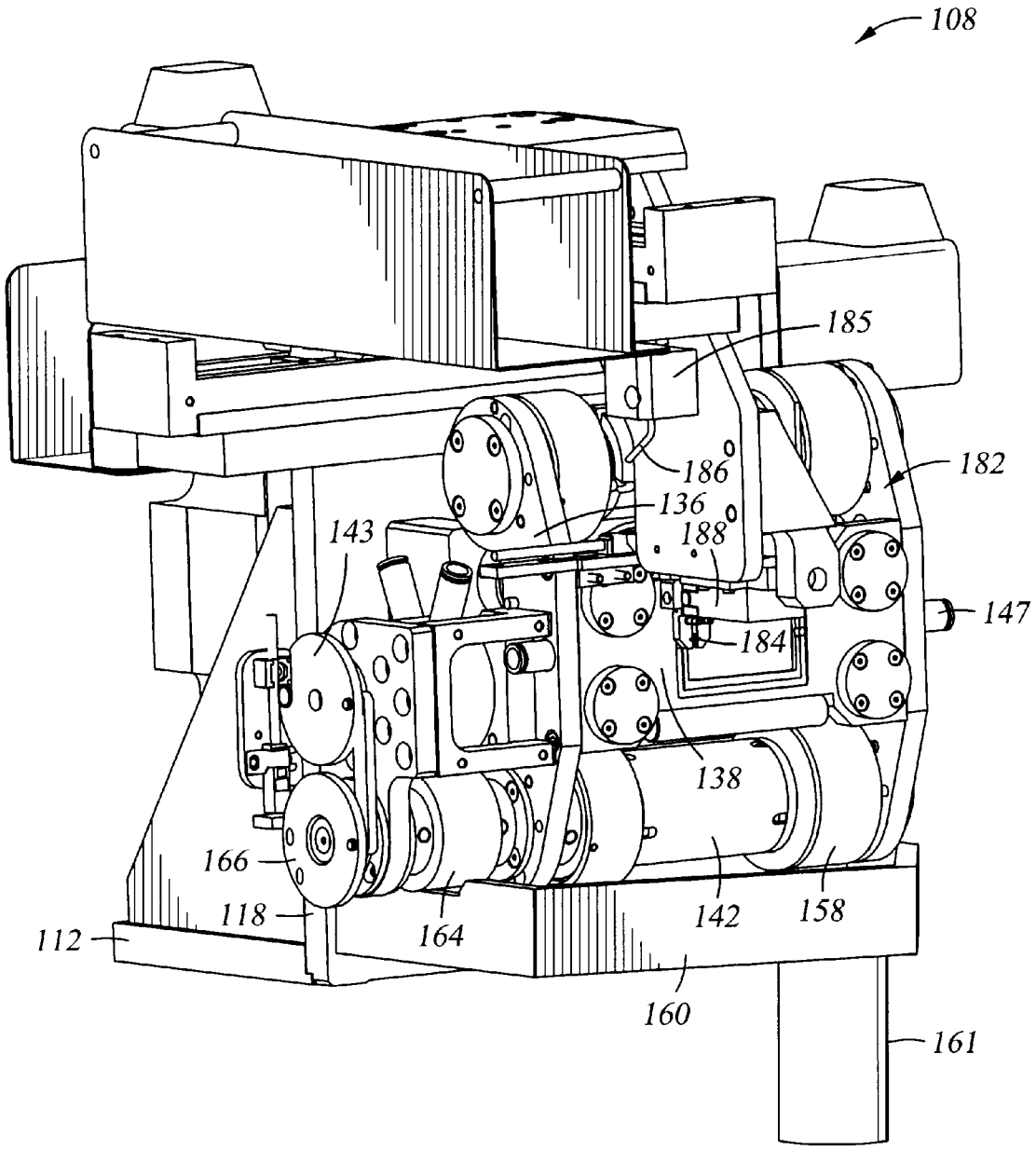
FIG. 3 is a substantially side perspective view of an optical-subsystem polishing tool of FIG. 1.
Figure 4:
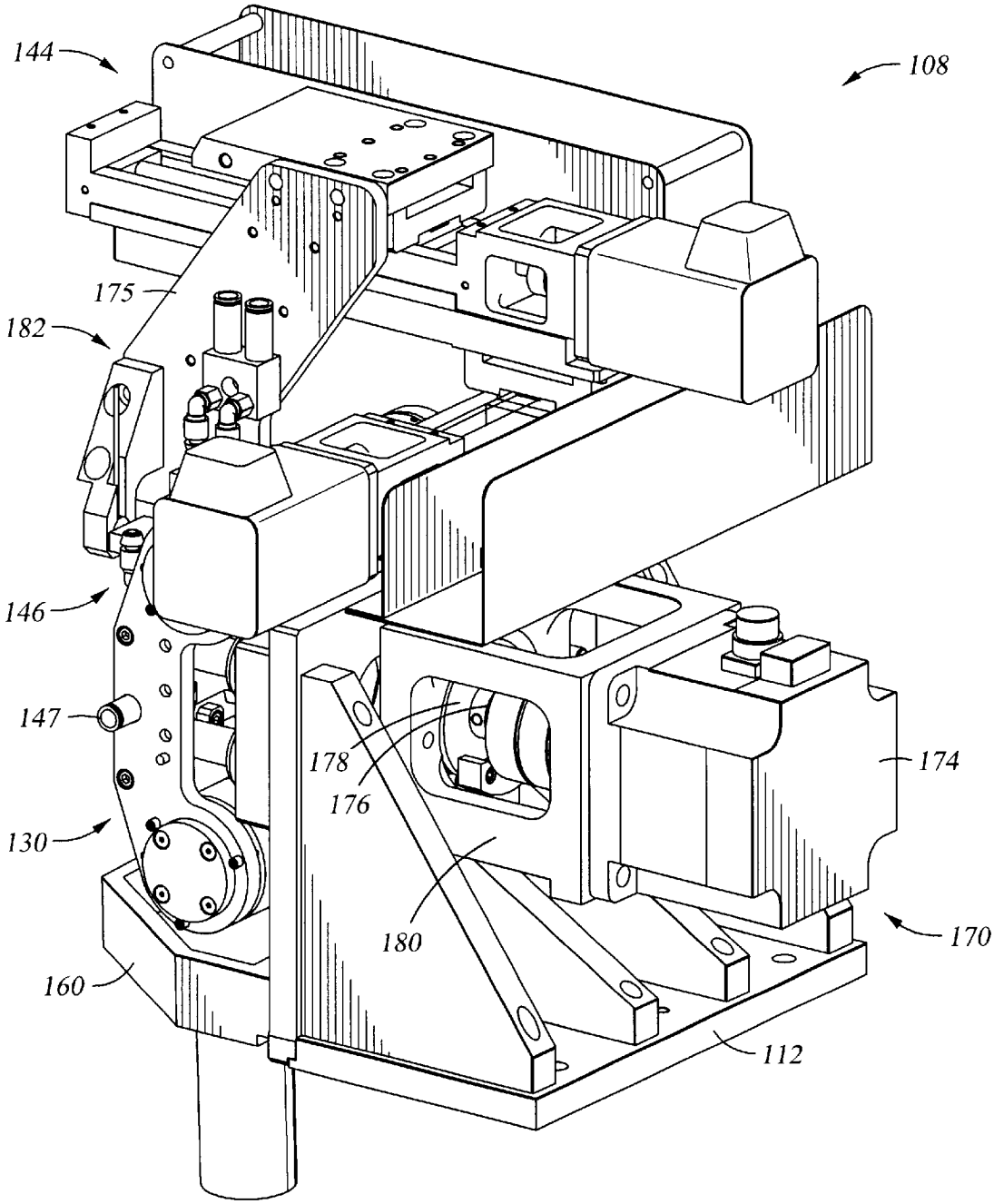
FIG. 4 is a substantially back view of the optical-subsystem polishing tool of FIG. 1.

FIGS. 2, 3, and 4, are a substantially front, side, and back perspective views, respectively, illustrating one embodiment of a polishing apparatus 108. The polishing apparatus 108 may be used to polish the interconnect surfaces of optical components such as ferrules. The term ferrule is used herein to denote a fiber-optic cable connector. Ferrules generally have three parts, a flange portion usually made of a rigid material such as stainless steel to allow the ferrule to be mechanically coupled to an optical subassembly, a body, and an optical transmission portion having a small center opening used to receive a fiber optic cable therein. The body of the ferrule is typically made of materials such as zirconia, alumina, and the like, adapted to support the fiber optic cable. Ferrule connectors are available in several different light transmission modes such as single mode used to transmit one signal per fiber, or multimode used to transmit many signals per fiber, depending on the number of wavelengths contained within the transmission.

The polishing apparatus 108 includes a body 112, a support 118, and a mounting plate 115. In one aspect, the body 112, support 118, frame 101, and mounting plate 115 are mounted to each other using conventional fasteners such as screws, bolts, nuts, and the like, and in another aspect may be a single component. While in one aspect, the support 118 is vertically mounted on the mounting plate 115 to define a vertical polishing position for an orbital assembly 120 to help in the removal of polishing debris, it is contemplated that the orbital assembly 120 may mounted in any position to perform the same polishing function. In one aspect, a collection tray 160 is disposed under the orbital assembly 120 to collect debris and fluids during processing. The tray 160 is coupled to a drain 161 that is fluidly coupled to a waste collection system or container (not shown).

The orbital assembly 120 includes a polishing assembly 130 and a spacer 132 flexibly coupled to the polishing assembly 130 and rigidly mounted to the support 118. The polishing assembly 130 is positioned to allow the optical component to be polished at generally an orthogonal direction relative the support 118. The polishing assembly 130 includes a right and left side plate 134,136, respectively, adapted to support a polishing table 138, a polishing material supply apparatus 140, and a polishing material receiver 142. In one aspect, the polishing table 138 is formed from a rigid material having a low coefficient of friction such as Teflon® impregnated aluminum, stainless steel, or other materials having a low friction surface thereon. In another aspect, the low friction surface may be applied to the polishing table 138 as a coating thereon. The polishing table 138 also includes a polishing surface recess 139 formed therein. In operation, a web of polishing material 165 is disposed over the polishing table 138 proximate the recess 139 and between the polishing material supplier 140 and polishing material receiver 142.

In one aspect, a sub-pad 156 typically composed of a flexible material such as rubber, vinyl, resin, plastic, and the like, that provides a flexible but firm polishing surface, is disposed in the recess 139. The sub-pad 156 is also adapted to provide a desired amount of flexure and resistance under the polishing material 165 against the component to form a desired radius of curvature for the optical surface being polished. In one aspect, the sub-pad 156 is adapted to form a radius of curvature dependant upon the pressure developed between the surfaces being polished, polishing material 165, and the sub-pad 156. For example, a lighter pressure between an optical component being polished, polishing material 165, and the sub-pad 156 provides for a flatter (i.e., smaller) radius of curvature whereas a greater pressure provides for a rounder (i.e., larger) radius of curvature. In another aspect, to provide for a greater polishing pressure to form a desired radius of curvature while decreasing the polishing time required, the sub-pad 156 includes a firmer surface having more flexure resistance thereon. It is contemplated that the compliance and resilience of the sub-pad 156 may be selected to provide any desired radius of curvature, flexure, and processing time.

In one aspect, the polishing material supply apparatus 140 is adapted to support a roll of polishing material 165 thereon and includes a brake 152. The brake 152 applies a frictional force to the polishing material supply apparatus 140 which keeps the roll of polishing material 165 taught. The polishing material supply apparatus 140 further includes a supply clutch 154 to control the dispensing of the polishing material 165 from the polishing material supply apparatus 140. The polishing material receiver 142 is coupled to a receiver clutch 164 mounted to the left side plate 136. The receiver clutch 164 constrains the web of polishing material movement to only one direction from the polishing material supply apparatus 140 to the polishing material receiver 142. The polishing material receiver 142 is rotated by a drive linkage 166 coupled to a drive apparatus 143 to take up and thereby advance the polishing material 165 across the polishing table 138 and sub-pad 156. In one aspect, the supply clutch 154, the receiver clutch 164, and brake 152 are operated together to control the advancement of the web of polishing material 165 while maintaining a taught web of polishing material 165 across the polishing table and sub-pad 156.

An air inlet/outlet 147 is disposed on the right side plate 134, in communication with the polishing table 138, and coupled to air conduction channels (not shown) that extend through the polishing table 138. The air conduction channels are coupled to holes 151 disposed around the recess 139 within a groove 158. A vacuum pressure may be provided to the groove 158 via the air inlet/outlet 147 through the holes 151 to hold the web of polishing material 165 to the sub-pad 156 and polishing table 138 during a polish process. In one aspect, the holes 151 may be distributed throughout the recess 139 and/or the groove 158 to allow the recess 139 under vacuum to hold the web of polishing material 165 to the sub-pad 156 and polishing table 138. In another aspect, air pressure may be provided from the air inlet/outlet 147 to the holes 151 during a polish material cleaning/renewing process to force the polishing material 165 away from the polishing table 138 releasing debris and/or allowing the polishing material 165 to be dispensed from the polishing material supply apparatus 140 to the polishing material receiver 142.

A component support 182, used to support optical components during processing, is mounted by a support 175 to a polishing force apparatus 144. The polishing force apparatus 144 is used to position and force optical components held by the component support 182 against the polishing material 165 and sub-pad 156. The polishing force apparatus 144 may be any apparatus such as a motor driven actuator adapted to move the component support 182 generally perpendicular toward and away from the polishing table 138, and as needed, during a polishing operation, maintains pressure of the optical component against the polishing material 165 and sub-pad 156. The polishing force apparatus 144 may be slidably mounted to a polishing position apparatus 146 which is mounted to an upper end 122 of the support 118. The polishing position apparatus 146 may be any apparatus such as a motor driven actuator adapted to laterally move the component support 182 generally parallel to the polishing table 138 and across the surface of the polishing material 165. In one aspect, the component support 182 is independently mounted to the frame 101 to provide vibration isolation from the polishing assembly 130. In another aspect, the polishing force apparatus 144 and polishing position apparatus 146 are mounted to the support 118 via flexible mounting fasteners such as rubber, vinyl, plastic, nylon, and the like, adapted to provide vibration damping therebetween.

In one aspect, the component support 182 includes a fluid nozzle 185 that is mounted to the support 175. The fluid nozzle 185 receives fluids such as polishing slurries, de-ionized water, and the like, from a fluid supply (not shown) and delivers the fluids through a nozzle extension 186. The nozzle extension 186 is aligned to spray a stream of fluids upon the surface of the polishing material 165.

In one aspect, the component support 182 further includes a sensor assembly 188, adapted to measure the polishing pressure of the optical component against the polishing material 165 during a polishing process and provide a signal to the process controller 105 indicative of the polishing pressure. In operation, the polishing force apparatus 144, sensor assembly 188, and process controller 105 form a polishing pressure feedback system to maintain a generally constant pressure between the optical component, polishing material 165, and the polishing table 138 throughout the polishing process.

Figure 5:
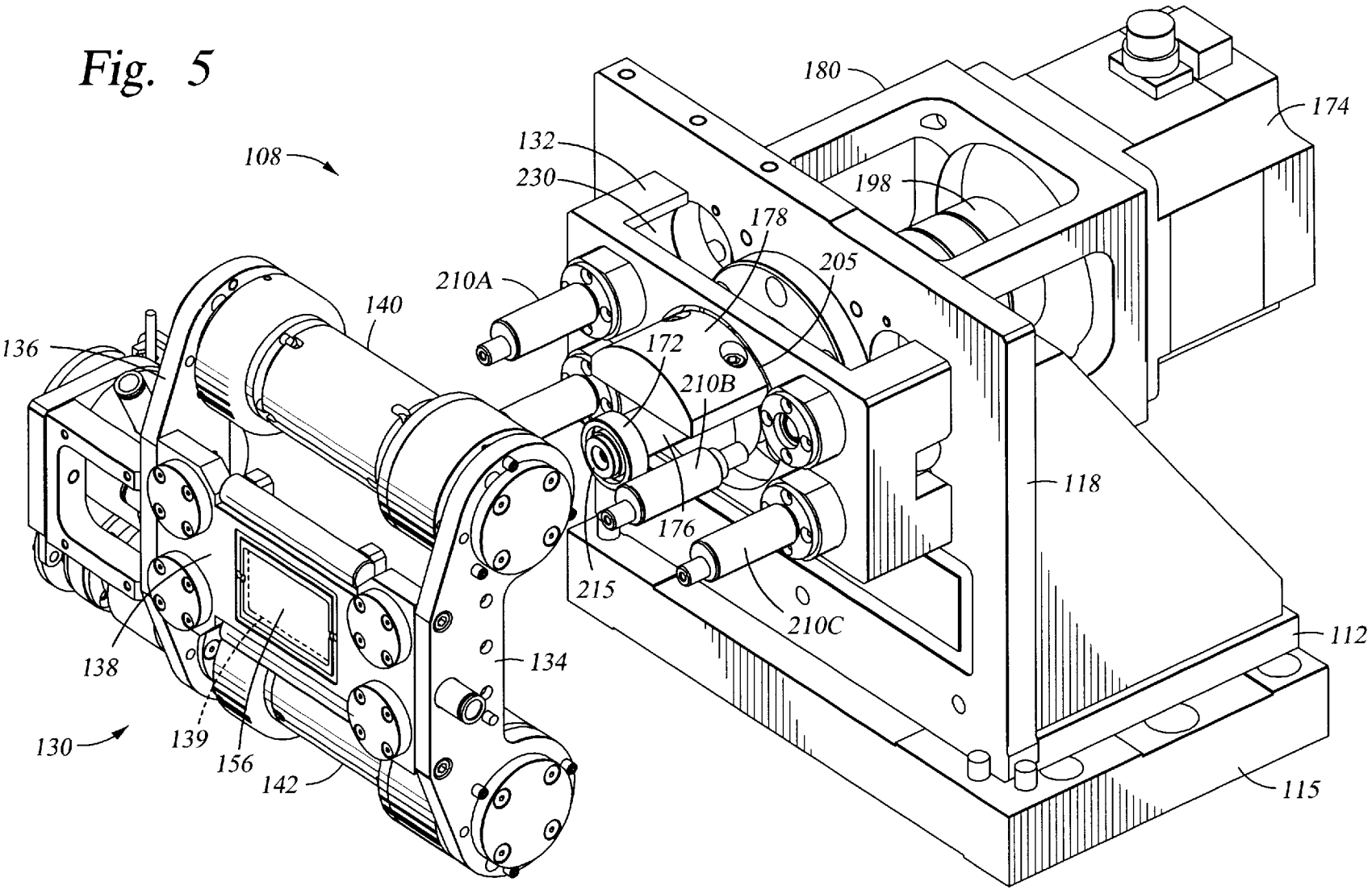
FIG. 5 is an exploded view of the optical-subsystem polishing tool of FIG. 1 illustrating the eccentric shaft and polishing orbital assembly.

FIG. 5 is an exploded view of the polishing apparatus 108 of FIG. 2 illustrating the eccentric shaft 176 and polishing assembly 130. FIGS. 1–4 are referenced as needed in the discussion of FIG. 5.

The polishing assembly 130 is coupled to an orbital actuator 170 to move the polishing assembly 130 in an orbital motion about a polishing plane that is generally orthogonal to the surface of the optical component being polished. The orbital actuator 170 includes a drive frame 180 supporting a motor 174 coupled to an eccentric shaft 176 extending generally perpendicular through the support 118. The support 118 includes a central opening 205 therein for receiving the eccentric shaft 176 therethrough. The central opening 205 is sized to allow the eccentric shaft 176 to move in an orbital motion within the central opening 205 without touching the support 118. One end of the eccentric shaft 176 is rotatably coupled to the polishing assembly 130 via a bearing 172. An opposite end of the eccentric shaft 176 is coupled to the shaft of the motor 174 via a flexible coupling 198. One or more counter balances 178 are disposed on the eccentric shaft 176 to offset the centrifugal and centripetal forces developed by the non-uniform mass distribution of the polishing assembly 130 during operation, thereby minimizing vibration.

As the eccentric shaft 176 axially spins, it orbitally rotates about a motor shaft center 215. As the bearing 172 generally provides some rotational friction, the polishing assembly 130 is rotationally urged about the shaft 176 in the direction of the shaft rotation. To rotationally constrain the polishing assembly 130, while allowing the polishing assembly 130 to simultaneously move with the orbital rotation of the eccentric shaft 176, four flexible supports 210A-D are rotatably mounted on one end to the spacer 132 and on an opposite end to the polishing assembly 130. The spacer 132 and support 118 form a counterbalance cavity 230 to hold the one or more counterbalances 178 therein. Thus, in operation, the polishing assembly 130 moves in an orbital fashion about the shaft 176 while maintaining a generally parallel position with respect to the support 118.

Figure 6:
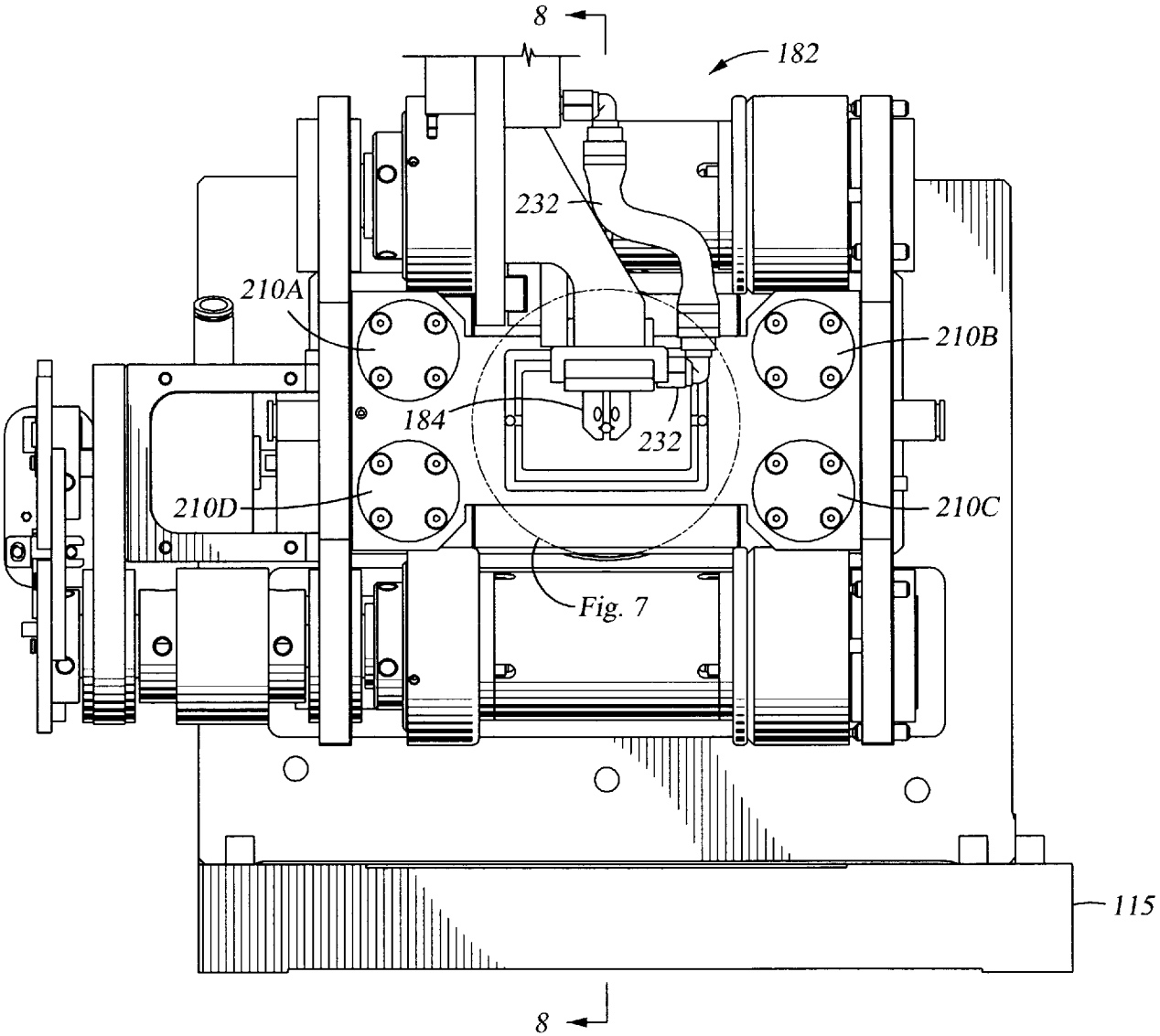
FIG. 6 is a front view of an optical component support.
Figure 7:
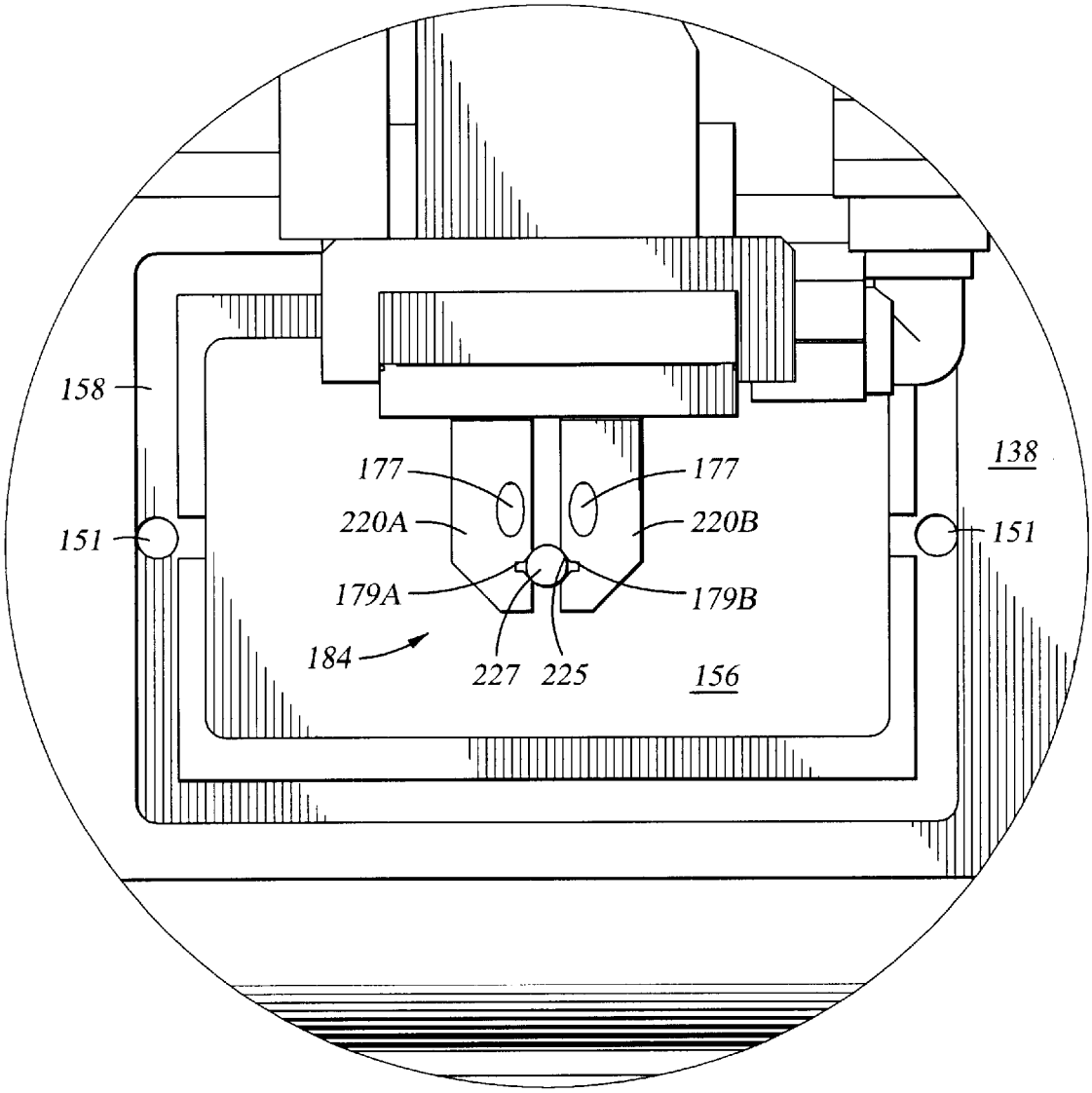
FIG. 7 is a partial-section al view of an optical component sup port.
Figure 8:
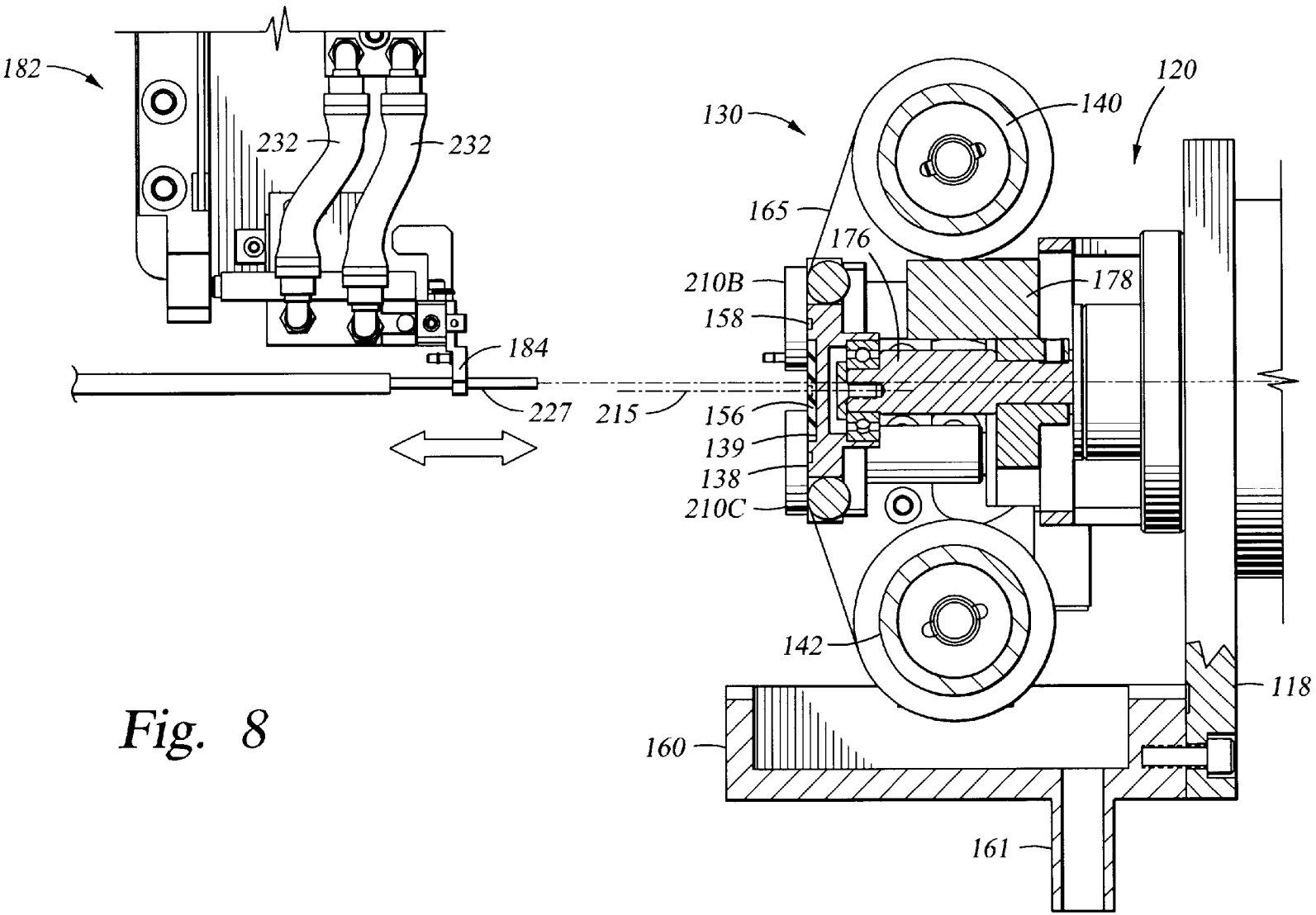
FIG. 8 is a side view of an optical component support.

FIGS. 6 and 7 are front views illustrating one embodiment of the component support 182 comprising a pair of grippers 184 (e.g., jaws) adapted to hold the optical component 227 to be polished in a desired position generally orthogonal to the polishing table 138. In one aspect, the grippers 184 include two blades 220A and 220B adapted to hold an optical component 227 therebetween. The two blades 220A, 220B include a component notch 179A and 179B that when brought together form a component groove 225 sized to hold various types of optical components therein and is adapted to hold the central axis of the optical component in a polishing position. In another aspect, the grippers 184 are operated pneumatically. In another aspect, the blades 220A and 220B include an air nozzle 177 to provide air pressure to clean the optical component and polishing material 165 of residue. FIG. 8 is a side view of the grippers 184 illustrating the grippers 184 holding an optical component 227 proximate the polishing table 138 and sub-pad 156.

Operation

Figure 9:
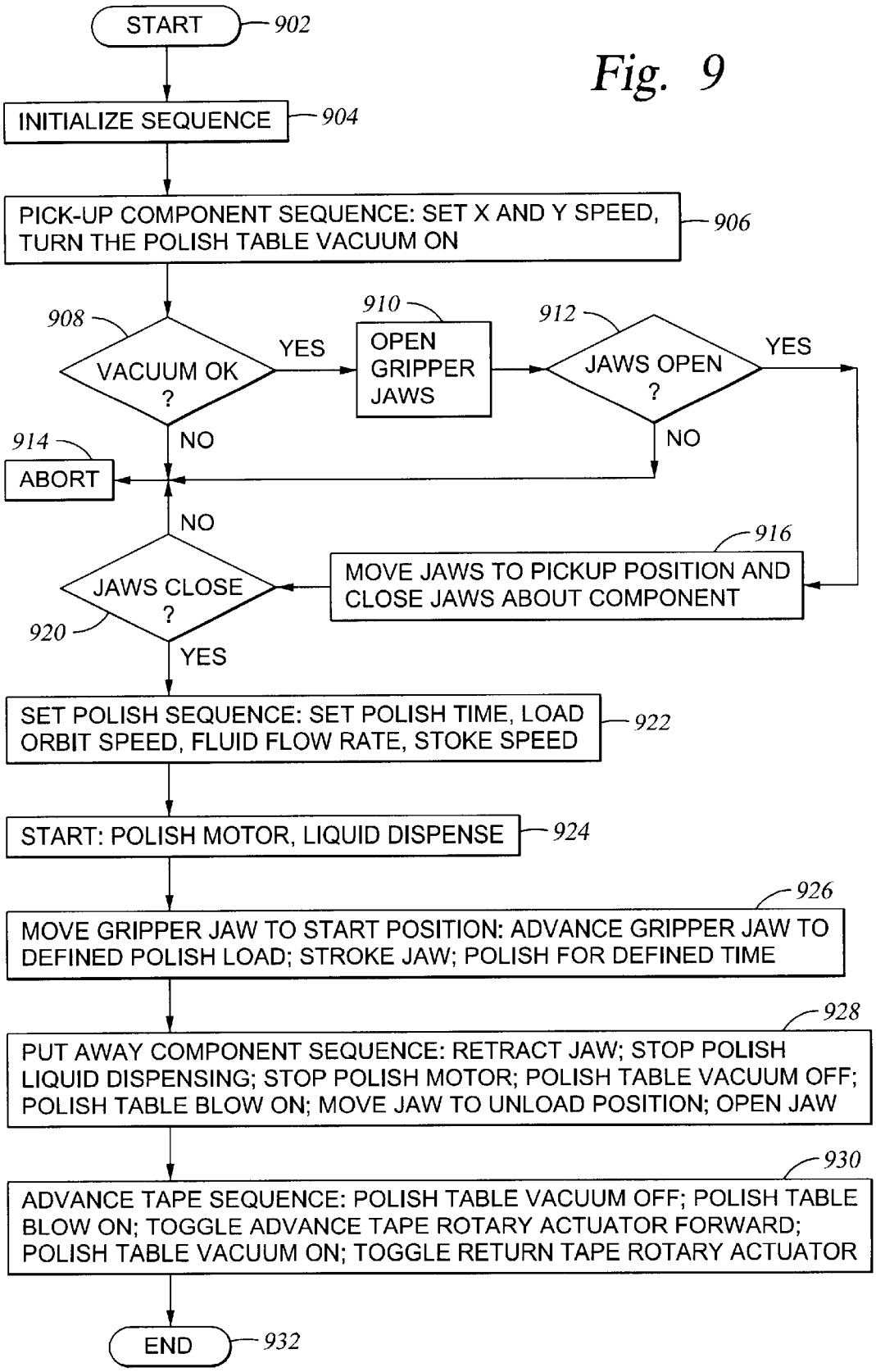
FIG. 9 is a flow diagram illustrating a polishing process using the polishing tool of FIG. 2.

FIG. 9 is a flow diagram illustrating one embodiment of a method 900 of a polishing sequence. FIGS. 1–8 are referenced as needed in the following discussion of FIG. 9.

The method 900 begins when, for example, a polishing process is initiated at step 902. At step 904, the method 900 initializes the polishing apparatus 108. At step 906, the method 900 checks to see if the polishing material 165 is available, sets the polishing table vacuum on to hold the polishing material 165 securely to the polishing table 138 using the groove 156, and starts the optical component pick up sequence by retrieving the settings for the polishing force apparatus 144 and the polishing position apparatus 146 from, for example, the process controller 105 via data line 90. Subsequently, at step 908, method 900 determines if the polishing table vacuum (not shown) is working to supply a vacuum to grove 158. If the polishing table vacuum is not working then the method 900 aborts the operation at step 914. If the polishing table vacuum is working properly, then the method 900 proceeds to step 910. At step 910, the grippers 184 are opened. At step 912, the method 900 determines if the grippers 184 are opened sufficiently to hold the optical component. If the grippers 184 are not open sufficiently then method 900 aborts at step 914. If the grippers 184 are open sufficiently then method 900 proceeds to step 916. At step 916, the method 900 sets the polishing force apparatus 144 and the polishing position apparatus 146 to an optical component pickup position and closes the grippers 184 around the optical component. At step 920, the method 900 determines if the grippers 184 are closed sufficiently to allow picking up the optical component. If the grippers 184 are not closed sufficiently, then method 900 aborts the process at step 914. If the grippers 184 are closed sufficiently to pickup and hold the optical component, the optical component is picked up. In one aspect, the gripper tension is determined by the amount of air-pressure used to close the grippers 184 around the component. At step 922, the method 900 retrieves the polishing sequence from the process controller 105 and sets the polishing time, polishing force for the polishing force apparatus 144, orbital rotation speed of the orbital actuator 170, de-ionized water fluid flow rate, and the stroke speed of the polishing position apparatus 146. At step 924, the motor 174 and liquid dispensers (not shown) are started. In one aspect, the motor 174 spins the eccentric shaft 176 at about 2000 rpm to about 4000 rpm. At step 726, the method 700 moves the grippers 184 holding the optical component to the position generally orthogonal the polishing table 138 and using the polishing force apparatus 144 forces the component surface being polished against the polishing surface of the polishing material 165 and the sub-pad 156, to establish the appropriate polishing force. In one aspect, the polishing force includes a minimum and maximum value whereby if the minimum or maximum values are exceeded the process controller alarms the system to abort the polish process. The polishing position apparatus 146 is set to a beginning position. In one aspect, the optical component is then polished for a predetermined time between about zero and two minutes while the polishing position apparatus 146 is advanced generally parallel to and proximate the polishing material 165, exposing the surface of the optical component being polished to a new portion of the orbiting polishing surface. At step 728, the polishing sequence is ended. The method 700 retracts the grippers 184 from the polishing position, sets the liquid dispensing to off, stops the motor 174, turns on an air blow through holes 151 to clean the surface of the polishing table 138 and release the polishing material 165. The method 700 then places the grippers 184 into a unload component position to unload the optical component. Once the optical component has reached an appropriate delivery location, the grippers 184 are opened to deliver the optical component to a receiving tray (not shown). Subsequently, the polishing apparatus 108 is prepared for the next component at step 930. At step 930, the method 900 advances the polishing material 165 via the polishing material receiver 142 to provide a clean polishing surface for the next optical component. Once the polishing material 165 is advanced, the polishing table vacuum is initiated to hold the material to the polishing table 138 and air jets 177 are activated to clean the polishing material surface of contaminates. Thus, the polishing apparatus 108 is set to polish the next optical component.

Staged Polish Process

The process regime from FIG. 9 can be used for one or more stages of polishing. In one aspect, as illustrated in FIG. 1, three stages of polishing are established by mounting three polishing apparatuses 108 in series to provide three stages of polishing. The first stage of polishing may be a coarse stage whereby the polishing material 165 used includes a more abrasive polishing surface relative to the subsequent polishing stages. The second stage of polishing receives the optical component polished by the first stage and polishes the optical component surface use a markedly less abrasive polishing surface than the first stage. The final stage of polishing accepts the optical component from the second stage and polishes the component with a markedly less abrasive surface than the second stage. Thus, each stage represents one polishing process that when combined provides a precisely polished optical component surface. In one aspect, a transfer carrier and transfer system (not shown) are used to shuttle the optical components between stages.

Although various embodiments which incorporate the teachings of the invention have been shown and described in detail herein, those skilled in the art can readily devise many other varied embodiments within the scope of the invention. For example, it is contemplated that the polishing apparatus 108 may be configured with polishing material 165 that has different polishing surfaces thereon. Therefore, by adjusting the polishing material 165, a single polishing apparatus 108 may be adapted to perform more than one type of polishing process. For example, a coarse polish surface may be on a first section of polish material, a fine on a second section of polish material, and a finish polish surface on a third section of the polish material. In addition, the various polish surfaces may be set side-by-side so that as the optical component is incrementally moved by the polishing position apparatus 146, the optical component 165 moves through each polishing process in a single stroke. In another aspect, the sub-pad 156 can be adapted to have several areas of differing radius of curvature for the same pressure. For example, the sub-pad 156 may have four quadrants whereby each quadrant provides for a different radius of curvature with the same pressure applied between the optical surface being polished, the polishing material 165, and sub-pad 156. Thus, by matching optical components to a quadrant having the desired radius of curvature for a given pressure and process time, the same polishing apparatus may be used to maintain an optimal throughput while polishing any number of different optical surfaces requiring different radiuses of curvature. In another aspect, the sub-pad 156 and the polishing material 165 are adapted to polish a multi-connector cable where the body of the ferrule includes a plurality of individual optical surfaces, each having their own radius of curvature requirements. The sub-pad 156 is adapted to receive the individual optical surfaces thereon.

While the foregoing is directed to the preferred embodiment of the present invention, other and further embodiments of the invention may be devised without departing from the basic scope thereof, and the scope thereof is determined by the claims that follow.

What is claimed is:

1. An apparatus for processing optical components, comprising:

a polishing apparatus comprising a polishing table and a polishing material supply apparatus adapted to supply a web of polishing material proximate the polishing table wherein the polishing material supply apparatus is coupled to a polishing material receiver having a web of polishing material and comprises a drag apparatus adapted to provide drag and tension to the web of polishing material;

an orbital actuator rotatably coupled to the polishing apparatus and adapted to rotate the polishing apparatus in an orbital motion; and a component support adapted to position a surface of an optical component in contact with polishing material adjacent the polishing table.

2. The apparatus of claim 1, wherein the polishing table comprises at least one groove therein proximate the polishing material wherein the groove comprises at least one air passage therein.

3. The apparatus of claim 2, wherein the air passage defines a vacuum inlet coupled to plurality of vacuum holes disposed within the groove to provide a vacuum pressure between the polishing table and the web of polishing material.

4. The apparatus of claim 2, wherein the air passage defines an air outlet coupled to plurality of air holes disposed within the groove to provide air pressure between the polishing table and the polishing material.

5. The apparatus of claim 2, wherein the polishing table comprises a low friction surface proximate the polishing material.

6. The apparatus of claim 5, wherein the polishing table comprises materials selected from aluminum, Teflon impregnated aluminum, stainless steel, and combinations thereof.

7. The apparatus of claim 5, wherein the low friction surface comprises materials selected from aluminum, Teflon impregnated aluminum, stainless steel, and combinations thereof.

8. The apparatus of claim 2, wherein the groove defines a perimeter of a polishing area comprising a flexible material therein having a resilient surface thereon proximate to and in slidable contact with the polishing material.

9. The apparatus of claim 8, wherein the resilient surface comprises a deformable surface thereon adapted to provide a radius of curvature to the surface of the optical component being polished.

10. The apparatus of, claim 1, wherein the drag apparatus comprises a drag brake.

11. The apparatus of claim 1, wherein the polishing material receiver comprises an advancement apparatus adapted to advance the polishing material from the polishing material supplier to the polishing material receiver.

12. The apparatus of claim 11, wherein the advancement apparatus comprises a drive apparatus adapted to advance the web of polishing material from the polishing material supply apparatus to the polishing material receiver.

13. The apparatus of claim 11, wherein the advancement apparatus comprises a clutch.

14. The apparatus of claim 1, wherein the orbital actuator comprises a motor coupled to an eccentric shaft rotatably coupled to the polishing apparatus.

15. The apparatus of claim 14, wherein the eccentric shaft comprises at least one counterbalance positioned on the shaft and sized to offset the centripetal and centrifugal forces generated during the orbital motion of the polishing apparatus.

16. The apparatus of claim 1, wherein the component support comprises a pair of jaws adapted to hold an optical component therebetween.

17. The apparatus of claim 16, wherein the component support comprises a polishing force apparatus adapted to move a surface of the optical component against the web of polishing material and polishing table.

18. The apparatus of claim 16, wherein the component support comprises a polishing position apparatus adapted to move a surface of the optical component across the web of polishing material.

19. The apparatus of claim 1, further comprising a pressure feedback system adapted to detect and maintain an optical component polishing pressure against the web of polishing material.

20. The apparatus of claim 19, wherein the pressure feedback system comprises a pressure sensor coupled to the component support.

21. The apparatus of claim 20, wherein the pressure feedback system further comprises a process controller coupled to and responsive to the pressure sensor.

22. An apparatus for processing optical components, comprising:

an orbital actuator flexibly coupled to a polishing apparatus comprising a polishing table; and a polishing material supply apparatus and a polishing material receiver wherein the polishing material receiver is adapted to receive a web of polishing material from the polishing material supply apparatus to define a renewable polishing surface adjacent the polishing table and wherein the polishing material supply apparatus comprises a drag apparatus adapted to provide drag and tension to the web of polishing material.

23. The apparatus of claim 22, further comprising a component support adapted to position the surface of an optical component in contact with the web of polishing material and polishing table.

24. The apparatus of claim 22, wherein the orbital actuator comprises a motor coupled to an eccentric shaft rotatably coupled to the polishing apparatus.

25. The apparatus of claim 22, wherein the polishing table comprises a low coefficient of friction surface.

26. The apparatus of claim 22, further comprising a polishing force apparatus adapted to position a surface of an optical component against the web of polishing material.

27. The apparatus of claim 22, further comprising a polishing position apparatus adapted to move a surface of an optical component from one polishing position to a second polishing position during a polishing process.

28. The apparatus of claim 22, wherein the polishing table comprises a recess having a flexible material therein.

29. The apparatus of claim 28, wherein the flexible material is comprised of rubber, vinyl, resin, plastic, and combinations thereof.

30. A method of processing optical components, comprising:

rotating a polishing apparatus comprising a polishing table thereon and a polishing material supply apparatus in an orbital direction, wherein a web of polishing material is supported in the polishing material supply apparatus in a manner to provide drag and tension to the web of polishing material;

providing from the polishing material apparatus a renewable web of polishing material positioned adjacent the polishing table;

maintaining a polishing pressure of a surface of an optical component against the web of polishing material and against the polishing table; and polishing the surface.

31. The method of claim 30, wherein the polishing apparatus is disposed generally orthogonal to the surface being polished.

32. The method of claim 30, wherein aligning the renewable web of polishing material received from the polishing material apparatus on the polishing table comprises aligning the polishing table to define a polishing plane generally aligned and orthogonal to the surface.

33. The method of claim 30, wherein polishing the surface comprises providing a flexible polishing surface on the polishing table and pressing the surface against the web of polishing material supported by the flexible polishing surface.

34. The method of claim 33, further comprising forming the radius of curvature in response to the pressure of the surface against the web of polishing material supported by the flexible polishing surface.

35. The apparatus of claim 33, wherein at least one radius of curvature is defined by the amount of deflection of the flexible polishing surface in response to pressure thereon wherein a greater deflection defines a greater radius of curvature and a lesser deflection defines a lesser radius of curvature.

36. The method of claim 30, wherein maintaining the polishing pressure of a surface of an optical component against the web of polishing material and against the polishing table further comprises detecting and adjusting the polishing pressure.

37. The method of claim 36, wherein detecting and adjusting the polishing pressure comprises receiving a signal from a pressure sensor wherein the signal is indicative of the pressure of the surface against the web of polishing material and polishing table, processing the signal at a process controller, and adjusting the pressure of the surface against the web of polishing material and polishing table to a desired polishing pressure.

38. The method of claim 30, further comprises moving the surface laterally across the web of polishing material during the polishing process.

39. The method of claim 38, wherein moving the surface across the web of polishing material comprises, positioning the surface at a first polishing position, then, while polishing the surface, moving the surface to a second polishing position while maintaining contact the web of polishing material.

40. The method of claim 30, further comprising advancing the web of polishing material to provide a new portion of the web of polishing material to the surface.

41. The method of claim 40, wherein the polishing material supply apparatus comprises a polishing material receiver to take up the web of polishing material-and a drag apparatus to keep the web of polishing material taught across the polishing table.

42. The method of claim 40, wherein the polishing material supply apparatus comprises a polishing material advancement apparatus for advancing the web of polishing material.

43. The method of claim 42, wherein the polishing material advancement apparatus comprises a clutch apparatus for controlling the advancement of the web of polishing material.

44. The method of claim 30, further comprising subsequent to aligning a renewable web of polishing material received from the polishing material apparatus adjacent the polishing table, forming a vacuum between the web of polishing material and the polishing table to secure the web of polishing material thereon.

* * * * *